US007449823B2

(12) United States Patent
Menken et al.

(10) Patent No.: US 7,449,823 B2
(45) Date of Patent: Nov. 11, 2008

(54) SPARK PLUG WITH SPECIFIC ELECTRODE MATERIAL

(75) Inventors: Lars Menken, Donzdorf (DE); Thomas Kaiser, Stuttgart (DE); Jochen Boehm, Marbach A.N. (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/321,379

(22) Filed: Dec. 28, 2005

(65) Prior Publication Data

US 2006/0158082 A1 Jul. 20, 2006

(30) Foreign Application Priority Data

Dec. 28, 2004 (DE) ..... 10 2004 063 077

(51) Int. Cl.
*H01T 13/20* (2006.01)

(52) U.S. Cl. ..... 313/141; 123/169 EL

(58) Field of Classification Search ..... 313/141; 123/169 EL
See application file for complete search history.

(56) References Cited

U.S. PATENT DOCUMENTS

| | | | | |
|---|---|---|---|---|
| 4,743,793 | A | 5/1988 | Toya et al. | |
| 4,795,944 | A * | 1/1989 | Stimson | 313/136 |
| 5,456,624 | A * | 10/1995 | Moore et al. | 313/142 |
| 5,990,602 | A * | 11/1999 | Katoh et al. | 313/141 |
| 6,019,077 | A * | 2/2000 | Gorokhovsky | 123/169 EL |
| 6,412,465 | B1 * | 7/2002 | Lykowski et al. | 313/141 |
| 6,664,719 | B2 * | 12/2003 | Matsutani et al. | 313/141 |
| 2006/0043856 | A1 * | 3/2006 | Matsutani et al. | 313/141 |

* cited by examiner

*Primary Examiner*—Peter Macchiarolo
(74) *Attorney, Agent, or Firm*—Kenyon & Kenyon LLP

(57) ABSTRACT

An electrode material based on an alloy or mixed compound, the alloy or mixed compound containing at least two of the elements platinum, palladium, iridium, rhenium, rhodium or ruthenium and, in addition, at least one oxide of the elements zirconium, hafnium, yttrium or magnesium.

9 Claims, 1 Drawing Sheet

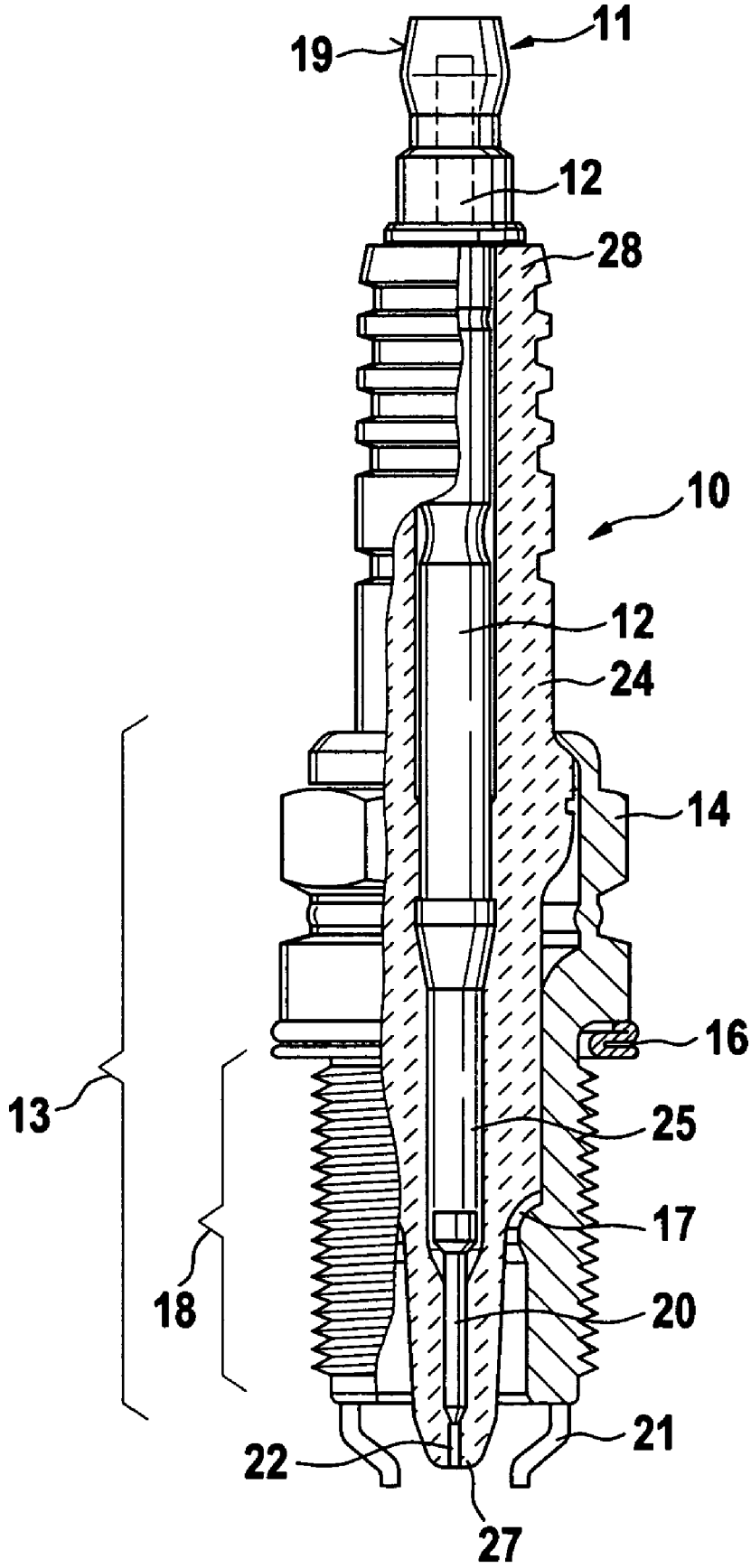
19
11
12
28
10
12
24
14
16
13
25
17
18
20
21
22
27

SPARK PLUG WITH SPECIFIC ELECTRODE MATERIAL

BACKGROUND INFORMATION

Electrode materials, in particular for applications in the field of spark-plug electrodes, have to meet extreme requirements in terms of corrosion and temperature resistance. High-melting and difficult-to-oxidize metal alloys are primarily used for this purpose. Therefore, inter alia, nickel alloys are used as the base alloy for center and ground electrodes of spark plugs. Since especially the regions of spark-plug electrodes where the actual sparking occurs must, in addition, be highly resistant to spark erosion, spark-plug electrodes are increasingly equipped with noble-metal inserts or platelets because these provide better long-term durability for the spark plug.

U.S. Pat. No. 4,743,739, for example, describes spark plugs whose center and/or ground electrodes are provided with a noble-metal containing material in their spark-forming region. For this purpose, the center electrode has one or more recesses which are filled with a noble-metal containing powder. This noble-metal containing powder is produced from a metal powder based, for example, on zirconium, which is coated with one or more layers of noble metal. The cost of such a noble-metal containing material is indeed relatively low, but it has limited resistance to spark erosion.

In contrast, an object of the present invention is to provide an electrode material that is cost-effective, but yet highly resistant to spark erosion.

SUMMARY OF THE INVENTION

An object of the present invention is advantageously achieved by an electrode material according to the present invention. This electrode material has a noble-metal content that significantly improves the electrode material's resistance to spark erosion. At the same time, however, the noble-metal content is limited to such an extent that the electrode material can be produced at a reasonable cost. To ensure the electrode material's resistance to high-temperature, no alloying additions that are volatile at elevated temperatures are used. In this manner, an electrode material is provided which is suitable for forming electrodes which have to be highly resistant to spark erosion for application-related reasons.

Thus, for example, it is advantage for the electrode material to contain an alloy or mixed compound containing at least two of the elements platinum, palladium, iridium, rhenium, rhodium or ruthenium and, in addition, at least one oxide of the elements zirconium, hafnium, yttrium or magnesium; the oxide content in the electrode material advantageously being 0.01 to 5% by weight. This appreciable oxide content increases the thermal stability of the electrode material without increasing its susceptibility to wear.

It is also advantageous for the electrode material to contain 10 to 30% by weight of rhodium or iridium as an alloying partner. This provides high resistance to spark erosion.

When using the electrode material in ignition devices, such as spark plugs, a particularly simple manufacturing process can be used because of the high temperature-resistance of the electrode material. In the process, first, an electrode containing the electrode material is at least partially inserted into an opening of a ceramic initial blank of the ignition device to be manufactured, after which the initial blank is subjected to a heat treatment. In this process, the electrode is fixed with an interference fit in the opening by shrinkage of the initial blank material, without the need for a separate, complex fixing step, such as laser or resistance welding.

BRIEF DESCRIPTION OF THE DRAWING

The FIGURE shows an exemplary embodiment of a spark plug according to the present invention in a sectional view.

DETAILED DESCRIPTION

The FIGURE shows a spark plug containing an electrode material according to the present invention. Spark plug 10 includes a tubular metallic shell 13 in which is disposed a ceramic insulator 24. At combustion-chamber end 27 of insulator 24, the insulator surrounds a center electrode 22, electrically insulating it from shell 13. Moreover, the insulator contains a contact pin 20 which serves to transfer the voltage to center electrode 22 and is provided with a connection means 11 at its connection end 28. Connection means 11 provides electrical contacting of center electrode 22 to an external voltage supply (not shown) and essentially includes a terminal stud 12 which, in addition, is provided with a thread and a terminal nut 19 at its connection end. Located between connection means 11 and contact pin 20 is a burn-off resistor 25 which is made of an electrically conductive glass and which both mechanically anchors the spark plug components disposed in insulator 24 and provides a gas-tight seal against the combustion pressure. An inner sealing seat 17 which seals the interior of spark plug 10 from the combustion chamber is located between insulator 24 and shell 13.

One or more ground electrodes 21 are welded to shell 13. The ignition spark is produced between the ground electrodes and center electrode 22.

Shell 13 is provided on its outside with a hexagon 14, allowing the spark plug to be screwed into an engine block. Also provided is an outer sealing seat 16 which seals the ambient atmosphere from the combustion chamber. The screw thread 18 formed on shell 13 serves to anchor the spark plug in the engine block.

At least one of electrodes 21, 22 is made, at least in part, based on a noble-metal containing electrode material. The electrode material is preferably an alloy or mixed compound containing at least two of the elements platinum, palladium, iridium, rhenium, rhodium or ruthenium and, in addition, at least one oxide or mixed oxide of the elements zirconium, hafnium, yttrium or magnesium. Consequently, the alloys or mixed compounds in question can be ternary or quaternary alloys or mixed compounds.

The main constituent of the alloy or mixed compound, preferably platinum, is contained in the electrode material in a concentration of, for example, more than 70% by weight and less than 90% by weight. The second metallic constituent of the alloy or mixed compound, in particular rhodium or iridium, is preferably contained in a concentration of from 10 to 30% by weight, in particular 16 to 22% by weight. The content of oxide or mixed oxide of the elements zirconium, hafnium, yttrium or magnesium in the alloy or mixed compound is preferably not more than 5% by volume, and is, for example, 0.01 to 5% by weight, in particular 0.1 to 2% by weight. This type of electrode material provides good hot-corrosion and erosion resistance of electrodes 21 and/or 22.

In addition to the constituents mentioned, the electrode material may contain further components, especially metallic components.

In order to manufacture spark plug 10, especially center electrode 22 is preferably entirely made of the electrode material described above. The center electrode is formed, for example, as a pin having an enlarged head, the pin having a total length of about 1 mm and a diameter of about 0.8 mm, and the head area of the pin that constitutes the actual spark-producing zone of center electrode 22 having a diameter of 0.08 mm and a height of 0.05 mm.

Center electrode 22 is then placed into combustion-chamber end 27 of a initial blank of insulator 24 such that the pin is inserted preferably up to its head area in an opening or bore of the initial blank. Then, the initial blank is sintered, during which the pin area of center electrode 22 is fixed with an interference fit in the opening of insulator 24 by shrinking processes of the insulator ceramic. The sintering process is carried out at a temperature of about 1650° C. for a period of about 2 hours.

In addition to the center electrode, the ground electrode can also be made from the electrode material, at least in some regions. For this purpose, the electrode material can also be inserted in the form of a plate-like insert into the base material of the ground electrode.

The use of the electrode material of the present invention is not limited to spark-plug electrodes. Rather, the electrode material can be generally used for hot-gas applications, such as for electrodes in respective gas sensors.

What is claimed is:

1. An ignition device comprising a center electrode and a ground electrode, the center electrode entirely made of an electrode material including:

at least one of an alloy and a mixed compound containing (a) at least two of the following elements: platinum, palladium, iridium, rhenium, rhodium and ruthenium, and (b) at least two oxides of at least one of the following elements: zirconium, hafnium, yttrium and magnesium.

2. The ignition device according to claim 1, wherein the electrode material is for making an erosion-resistant electrode.

3. The ignition device according to claim 1, wherein the at least two oxides are contained in a proportion of from 0.01 to 5% by weight.

4. The ignition device according to claim 1, wherein the at least one of the alloy and the mixed compound contains one of rhodium and iridium in a proportion of from 10 to 30% by weight.

5. The ignition device according to claim 1, wherein the ignition device is for an automobile.

6. The ignition device according to claim 1, wherein one of the center and ground electrodes is one of substantially pin-shaped and substantially plate-shaped.

7. The ignition device according to claim 1, wherein the center electrode is secured to an insulator by an interference fit.

8. An ignition device comprising:

a ground electrode; and a center electrode, the center electrode entirely made of an electrode material including at least one of an alloy and a mixed compound, the at least one of an alloy and a mixed compound containing (a) at least two of the following elements: platinum, palladium, iridium, rhenium, rhodium, and ruthenium, and (b) zirconium oxide.

9. The ignition device according to claim 7, wherein a spark producing zone has a height of 0.05 mm.

* * * * *